US010910765B2

(12) United States Patent
Ochiai

(10) Patent No.: US 10,910,765 B2
(45) Date of Patent: Feb. 2, 2021

(54) LEVER-TYPE CONNECTOR

(71) Applicant: Sumitomo Wiring Systems, Ltd., Mie (JP)

(72) Inventor: Wataru Ochiai, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/814,211

(22) Filed: Mar. 10, 2020

(65) Prior Publication Data

US 2020/0295509 A1 Sep. 17, 2020

(30) Foreign Application Priority Data

Mar. 12, 2019 (JP) ..... 2019-044595

(51) Int. Cl.
*H01R 13/629* (2006.01)

(52) U.S. Cl.
CPC ... *H01R 13/62955* (2013.01); *H01R 13/6295* (2013.01); *H01R 13/62977* (2013.01)

(58) Field of Classification Search
CPC ..... H01R 13/62955; H01R 13/6295; H01R 13/62977; H01R 13/62933; H01R 13/629; H01R 13/62; H01R 13/62905; H01R 13/62922; H01R 13/62916
USPC ..... 439/372, 157
See application file for complete search history.

(56) References Cited

U.S. PATENT DOCUMENTS 6,241,540 B1 * 6/2001 Tokuwa ..... H01R 13/62955 439/157
6,319,050 B1 * 11/2001 Miyazaki ..... H01R 13/62938 439/157
6,793,522 B2 * 9/2004 Yamashita ..... H01R 13/62938 439/157
7,063,548 B2 * 6/2006 Ohara ..... H01R 13/62938 439/157
7,137,844 B2 * 11/2006 Flowers ..... H01R 13/5812 439/372
7,591,668 B2 * 9/2009 Nakamura ..... H01R 13/641 439/489
7,878,825 B2 * 2/2011 Matsumura ..... H01R 13/6295 439/157

(Continued)

FOREIGN PATENT DOCUMENTS

JP 2003-223955 8/2003
JP 2010-160942 7/2010

*Primary Examiner* — Harshad C Patel
(74) *Attorney, Agent, or Firm* — Gerald E. Hespos; Michael J. Porco; Matthew T. Hespos

(57) ABSTRACT

A lever-type connector has a lever that rotates about a shaft on a first housing between a retracted position and a connection start position. The first housing and a second housing are connected by rotation of the lever from the connection start position. A detector is movable between a standby position and a detection position with respect to the lever. The lever includes a lock on an end separated from the shaft. The second housing includes a full locking portion to engage the lock when the housings are connected. The detector locks the lock at the standby position and becomes movable to the detection position when the full locking portion engages the lock. The first housing includes a housing-side lock, and the lever includes a lever-side lock that locks the housing-side lock at the retracted position. The lever-side lock is at a position different from the lock of the lever.

4 Claims, 13 Drawing Sheets

(56) References Cited

U.S. PATENT DOCUMENTS 9,178,306 B2 * 11/2015 Shimizu ..... H01R 13/62977
9,425,554 B2 * 8/2016 Iwatani ..... H01R 13/635

* cited by examiner

LEVER-TYPE CONNECTOR

BACKGROUND

Field of the Invention

The disclosure relates to a lever-type connector.

Related Art

Japanese Unexamined Patent Publication No. 2010-160942 discloses a lever-type connector with a female housing, a lever mounted rotatably about a center axis of rotation with respect to the female housing, and a male housing to be connected to the female housing by the rotation of the lever to a proper connection position. The connector also includes a detector movable to a standby position and a detection position with respect to the lever. The female housing includes a lock protrusion, and the lever includes a lock arm on an end part separated from the center axis of rotation. The lock arm holds the housings at the proper connection position by locking the lock protrusion.

The detector is locked by the lock arm and kept at the standby position while the housings are being connected. However, the detector is pressed by the lock protrusion locked by the lock arm and becomes movable to the detection position when the housings are connected properly (when the lever is at the proper connection position). A lever-type connector also is disclosed in Japanese Unexamined Patent Publication No. 2003-223955.

At the proper connection position, the lever is in a retracted posture in which the lock arm locks the lock protrusion of the female housing and a projection amount of the lever from the female housing is suppressed. Thus, if the lever is locked to the female housing at the proper connection position, the connector need not be bulky and interference with another connector or external matter is avoided. The lever preferably is in the same posture as at the proper connection position when the lever-type connector is transported. However, when the lever is at the proper connection position, the detector may be pressed by the lock protrusion and movable to the detection position. Thus, for example, a worker's hand may touch the detector to move the detector inadvertently to the detection position. A detector that has moved to the detection position must be returned to an initial position and a work load increases.

Accordingly, it is aimed to provide a lever-type connector capable of preventing an inadvertent movement of a detecting member.

SUMMARY

This disclosure is directed to a lever-type connector with a first housing and a lever that rotatable about a shaft of the first housing between a retracted position and a connection start position. A second housing is to be connected to the first housing by rotation of the lever from the connection start position. A detector is movable between a standby position and a detection position with respect to the lever. The lever includes a lock on an end part separated from the shaft, and the second housing includes a full locking portion to be locked to the lock when the first and second housings are connected properly. The detector is locked by the lock at the standby position and becomes movable to the detection position when the full locking portion is locked to the lock. The first housing includes a housing-side lock, and the lever includes a lever-side lock to be locked to the housing-side lock at the retracted position. The lever-side lock is at a position different from the lock of the lever.

The detector is locked by the lock at the standby position and the lever-side locking portion is locked to the housing-side locking portion. Thus, the lever is held at the retracted position with respect to the first housing. The lever does not project significantly from the first housing at the retracted position. Therefore, the lever-type connector in which the lever is at the retracted position is suitable in terms of transportation. The lever-side locking portion is disposed at the position different from the lock and the full locking portion is provided on the mating second housing. Thus, a state where the detector is locked by the lock at the standby position can be maintained satisfactorily. Accordingly, the detector is prevented from inadvertently moving from the standby position to the detection position.

The lever-side locking portion may be on an end part of the lever separated from the shaft. According to this configuration, a worker can perform an operation of releasing the locked state of each of the lever-side locking portion and the lock and other operations while holding the end part of the lever. Thus, work efficiency is excellent.

The retracted position may be the same position as when the full locking portion is locked to the lock to reach the proper connection. According to this configuration, when the first and second housings are connected properly, the lever-side locking portion is locked to the housing-side locking portion in addition to the locking of the full locking portion of the second housing to the lock of the lever. Thus, reliability in maintaining the connected state of the first and second housings is enhanced. Further, the lever can be kept at the same position both when the lever-type connector is transported and when the connection is completed.

According to the present disclosure, it is possible to provide a lever-type connector capable of preventing an inadvertent movement of a detector.

DETAILED DESCRIPTION

A specific example of the lever-type connector of the present disclosure is described below with reference to the drawings. Note that the present invention is not limited to these illustrations and is intended to be represented by claims and include all changes in the scope of claims and in the meaning and scope of equivalents.

A lever-type connector of this embodiment includes first and second housings 10, 11 that are connectable to each other. A lever 12 is mounted rotatably on the first housing 10, and a detector 13 is mounted movably on the lever 12. The lever 12 is rotated from a connection start position to a proper connection position. When the lever 12 is at the connection start position, the first and second housings 10, 11 are fit shallowly. When the lever 12 is at the proper connection position, the first and second housings 10, 11 are connected in a proper state. At the proper connection position, the lever 12 is in the same posture as at a retracted position. The detector 13 moves from a standby position to a detection position. The detector 13 is held at the standby position until the first and second housings 10, 11 are connected properly. However, the detector 13 becomes movable to the detection position as the first and second housings 10, 11 are connected properly.

<Second Housing 11>

Figure 1:
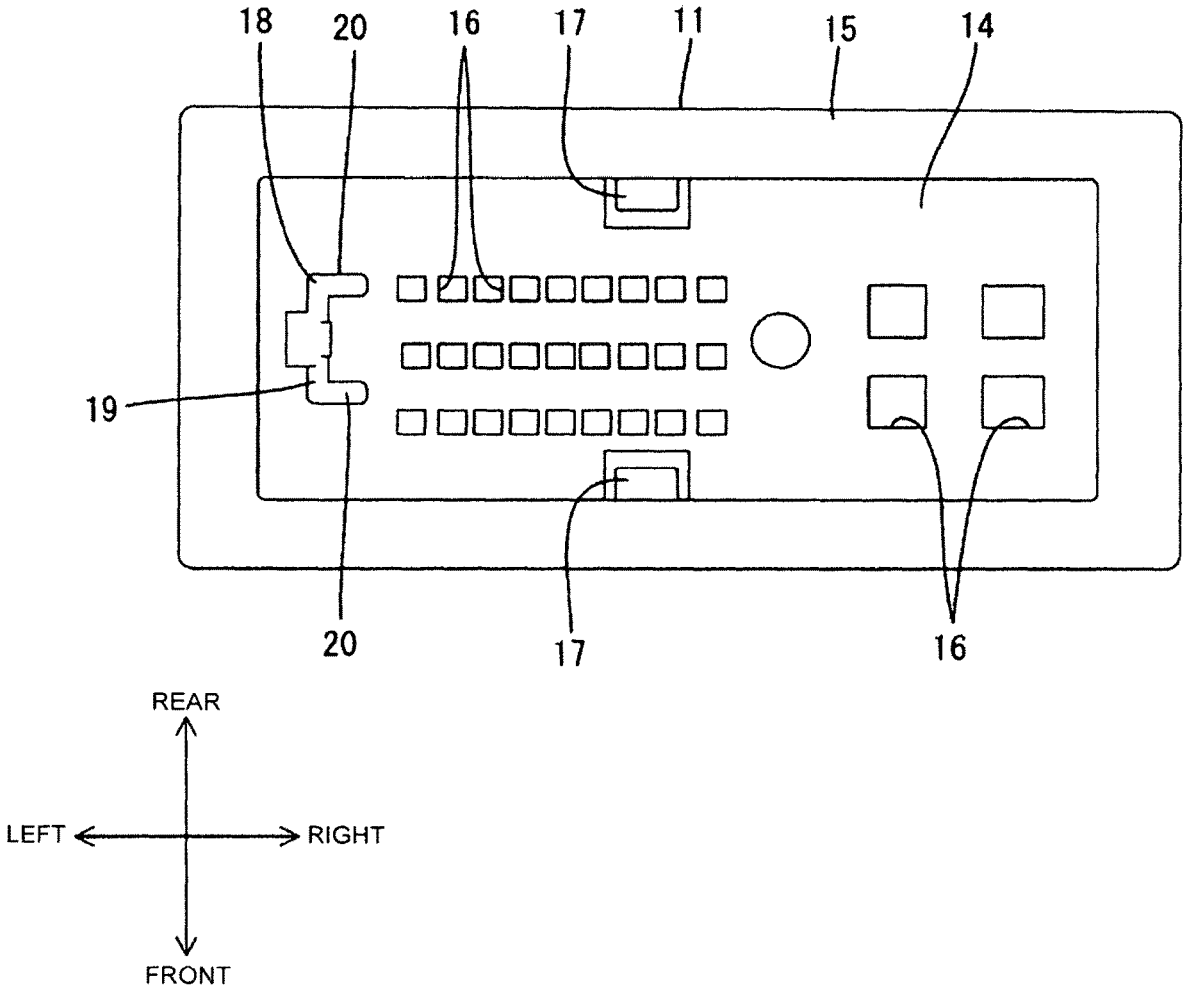
FIG. 1 is a plan view of a second housing in a lever-type connector according to one embodiment.

The second housing 11 is made of synthetic resin and is configured as a male housing. As shown in FIG. 1, the second housing 11 includes a second housing body 14 and a receptacle 15 projecting up (toward a side forward of the plane of FIG. 1) from the second housing body 14. The second housing body 14 includes second cavities 16 capable of accommodating body parts of unillustrated male terminal fittings. Tabs projecting from the body parts in the male terminal fittings project into the receptacle 15.

The receptacle 15 is a rectangular tube and includes cylindrical cam shafts 17 on the inner surfaces of front and rear walls facing each other.

Figure 2:
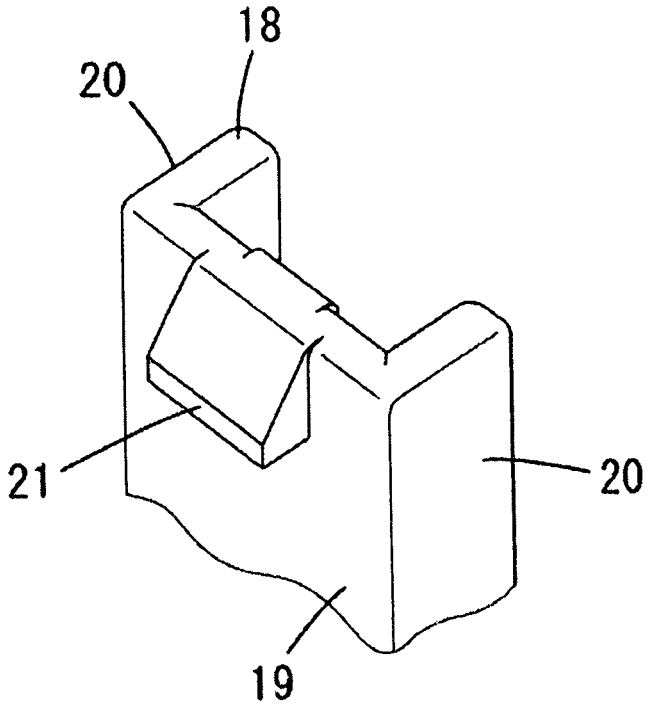
FIG. 2 is an enlarged perspective view of a tip part of a full locking portion.

The second housing 11 includes a full locking portion 18 projecting up from the second housing body 14 on one lateral side (left side in FIG. 1). The full locking portion 18 is a plate having a U-shaped cross-section and includes a locking body 19 arranged along a vertical direction and two reinforcing portions 20 projecting toward the other side (right side of FIG. 1) from the front and rear ends of the locking body 19, as shown in FIG. 2. A tip part (upper end part) of the full locking portion 18 projects up from an opening end of the receptacle 15. As shown in FIG. 2, the tip part of the full locking portion 18 includes a full locking projection 21 in the form of a claw projecting on a plate surface of the locking body 19 facing the one side.

<First Housing 10>

Figure 3:
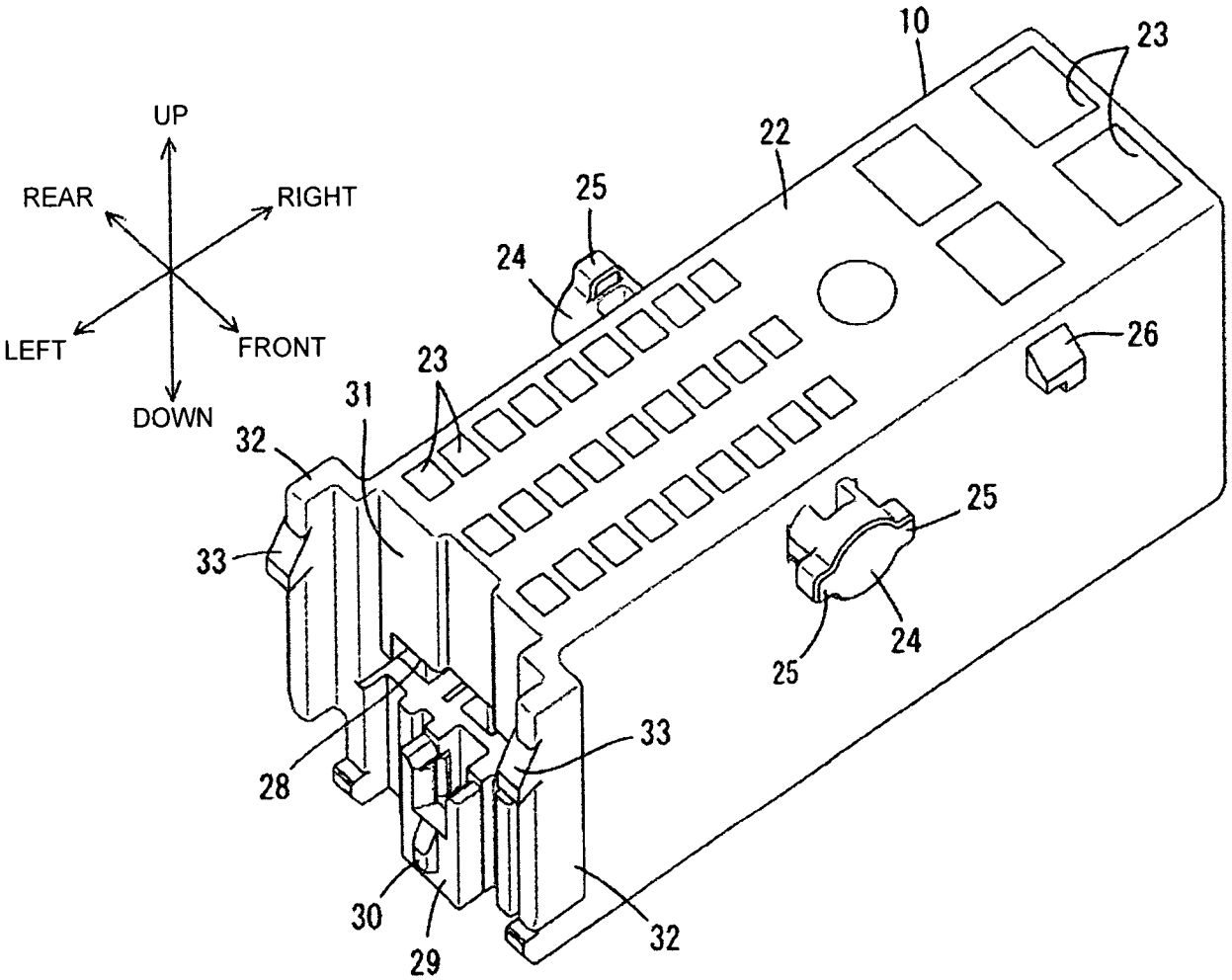
FIG. 3 is a perspective view of a first housing.

The first housing 10 is made of synthetic resin and configured as a female housing. As shown in FIG. 3, the first housing 10 includes a first housing body 22 having a rectangular cross-section long in a lateral direction. The first housing body 22 includes first cavities 23 capable of accommodating unillustrated female terminal fittings.

The first housing body 22 includes two shafts 24 on front and rear surfaces extending along the lateral direction. Each of the shafts 24 is cylindrical and includes retaining pieces 25 protruding in mutually different directions on a tip part. The first housing body 22 includes partial lock receiving portions 26 in the form of projecting bases on front and rear surfaces.

The first housing body 22 includes a mounting hole 28, into which a retainer 27 (see FIG. 10) is inserted, in an end surface on one lateral side (left side of FIG. 3). The mounting hole 28 is open long in a front-rear direction in a vertically central part of the first housing body 22. The retainer 27 functions to restrict the escape of each female terminal fitting from each first cavity 23 by being inserted to a proper depth into the mounting hole 28.

As shown in FIG. 3, the first housing body 22 includes a protrusion 29 below the mounting hole 28 on the end surface. The protrusion 29 includes a projection 30 on an end surface. The first housing body 22 includes a recess 31 slightly recessed from a lower side on an upper side of the end surface above the mounting hole 28. An operating part of the retainer 27 is inserted into the recess 31.

The first housing body 22 includes two walls 32 on both front and rear sides of the end surface across the mounting hole 28. The walls 32 are in the form of plates and extend in the vertical direction. Both walls 32 project toward one side after protruding toward both front and rear sides and are formed to have an L-shaped cross-section.

The first housing body 22 includes housing-side locks 33 in the form of projecting claws on an end surface on one side of each of the walls 32. The upper surfaces of the housing-side locks 33 are inclined down toward tips (see FIG. 11). The lower surfaces of the housing-side locks 33 are likewise inclined down toward the tips. Each of the housing-side locks 33 has the same thickness in the front-rear direction as the corresponding wall 32 and is continuous and flush with the front and rear surfaces of the wall 32.

<Lever 12>

Figure 4:
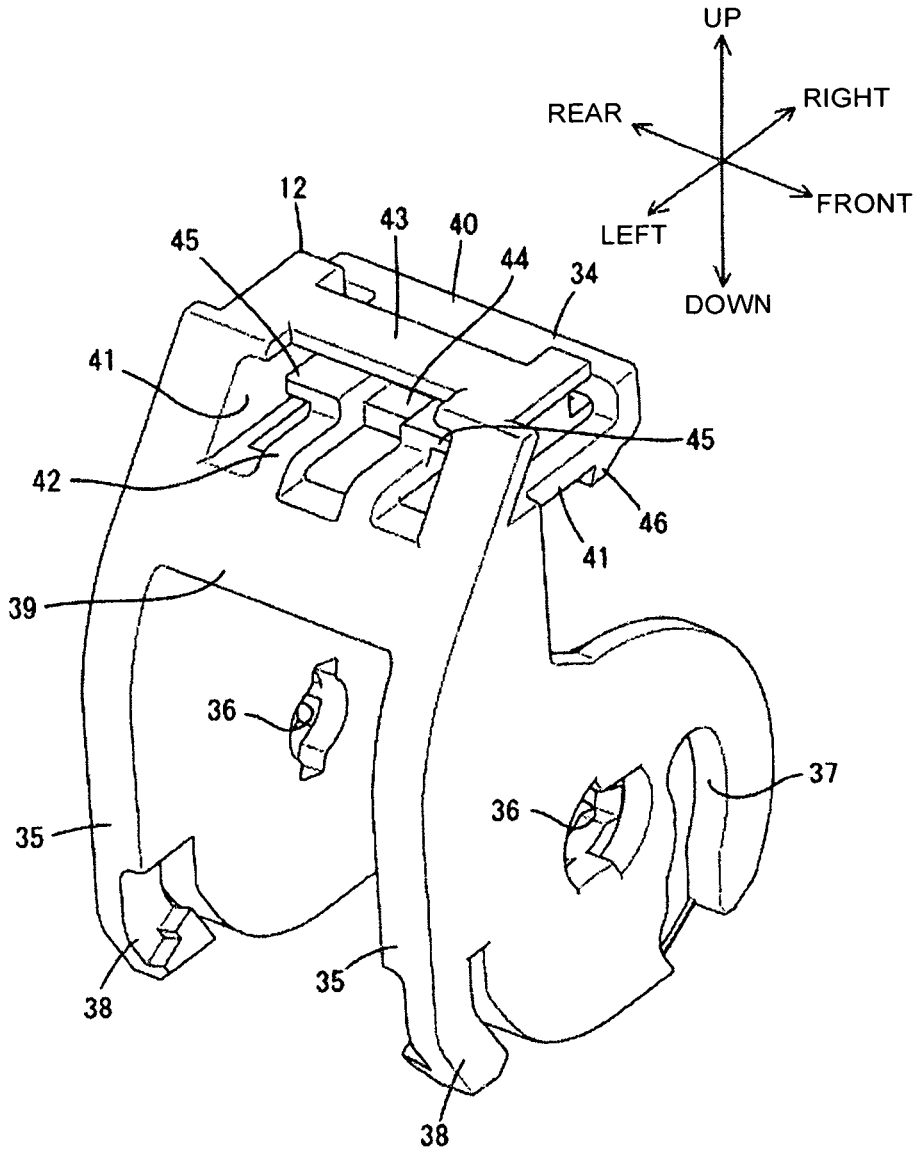
FIG. 4 is a perspective view of a lever.
Figure 5:
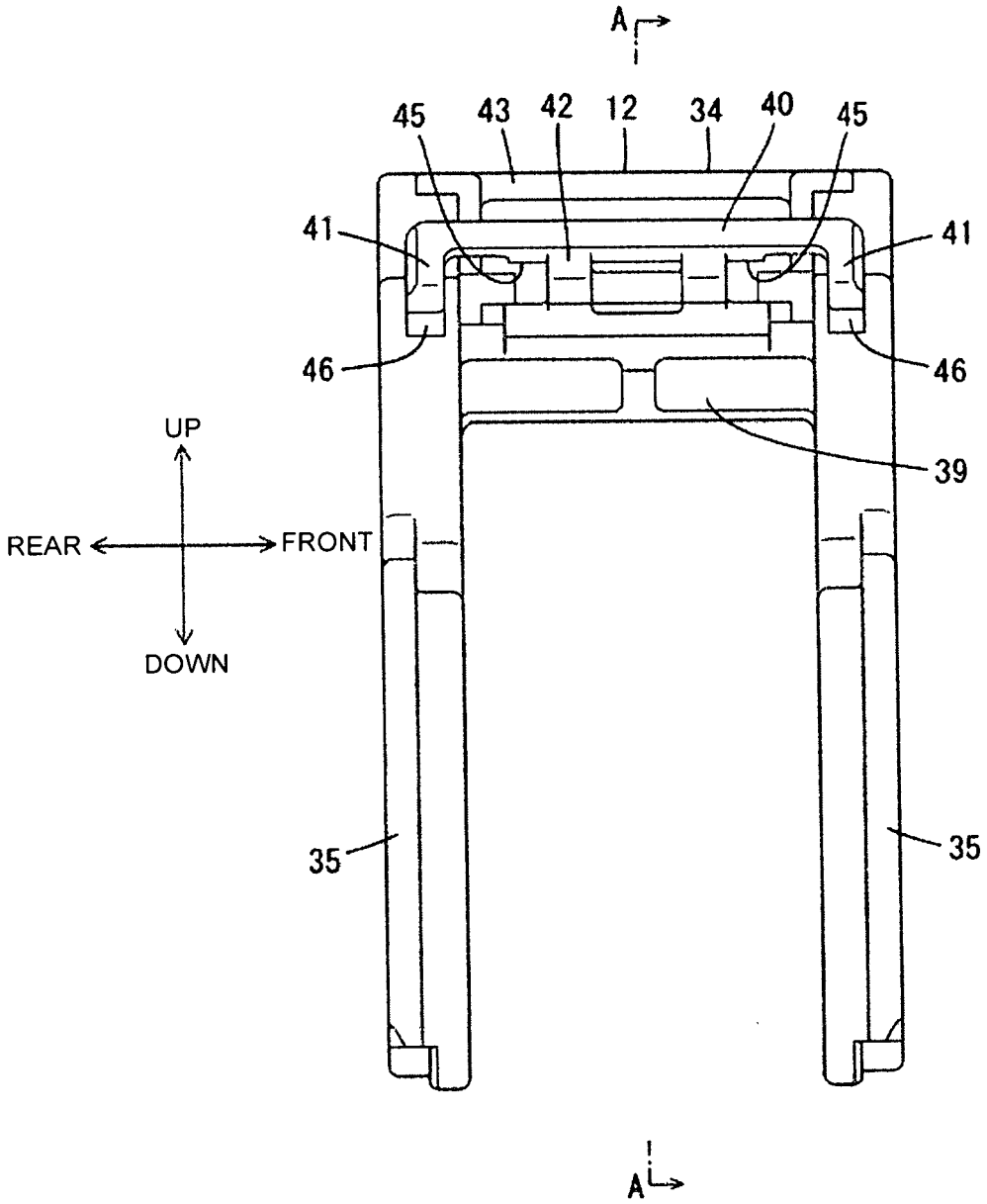
FIG. 5 is a side view of the lever.

The lever 12 is made of synthetic resin and, as shown in FIGS. 4 and 5, in the form of a U-shaped plate when viewed from one lateral side (side forward of the plane of FIG. 5 and based on a posture at the connection start position).

The lever 12 includes an operating portion 34 arranged along the front-rear direction on an upper end and two cams 35 projecting down in parallel to each other from both front and rear ends of the operating portion 34.

As shown in FIG. 4, each of the cams 35 includes a bearing hole 36 and a cam groove 37 extending in a curved manner from a position near the bearing hole 36 to an outer peripheral edge. The shafts 24 are inserted into the bearing holes 36 of the cams 35. In a state inserted in the bearing holes 36, the respective retaining pieces 25 are caused to face the outer surfaces of the cams 35 and the shafts 24 are retained by the cams 35. The lever 12 is rotatable about the shafts 24.

Figure 11:
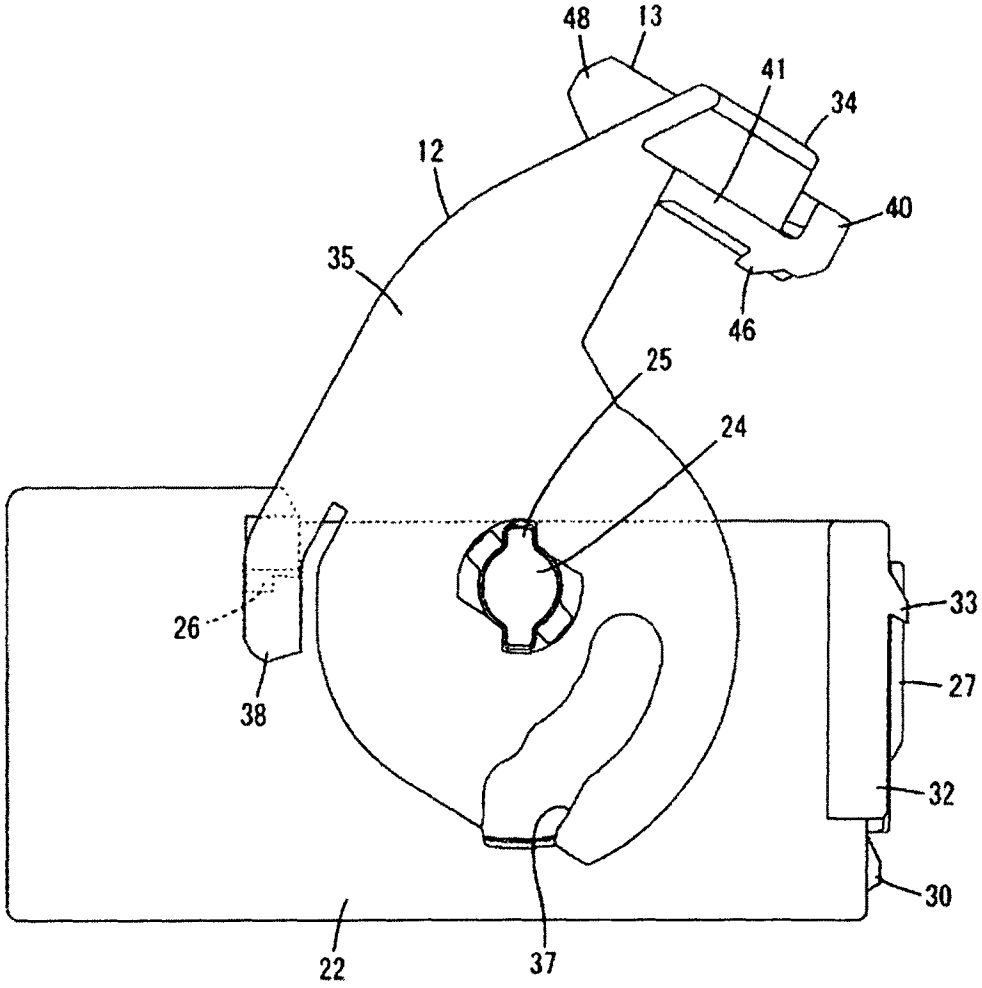
FIG. 11 is a front view showing a state where the lever is held at a connection start position with respect to the first housing.

Each of the cams 35 includes a partial locking portion 38 projecting along the outer peripheral edge. Both partial locking portions 38 respectively resiliently lock the partial lock receiving portions 26. In this way, as shown in FIG. 11, the lever 12 is held at the connection start position with respect to the first housing 10. When the lever 12 is at the connection start position, the operating portion 34 is arranged above and away from the first housing 10 and the entrances of the cam grooves 37 are arranged to face downward.

Figure 6:
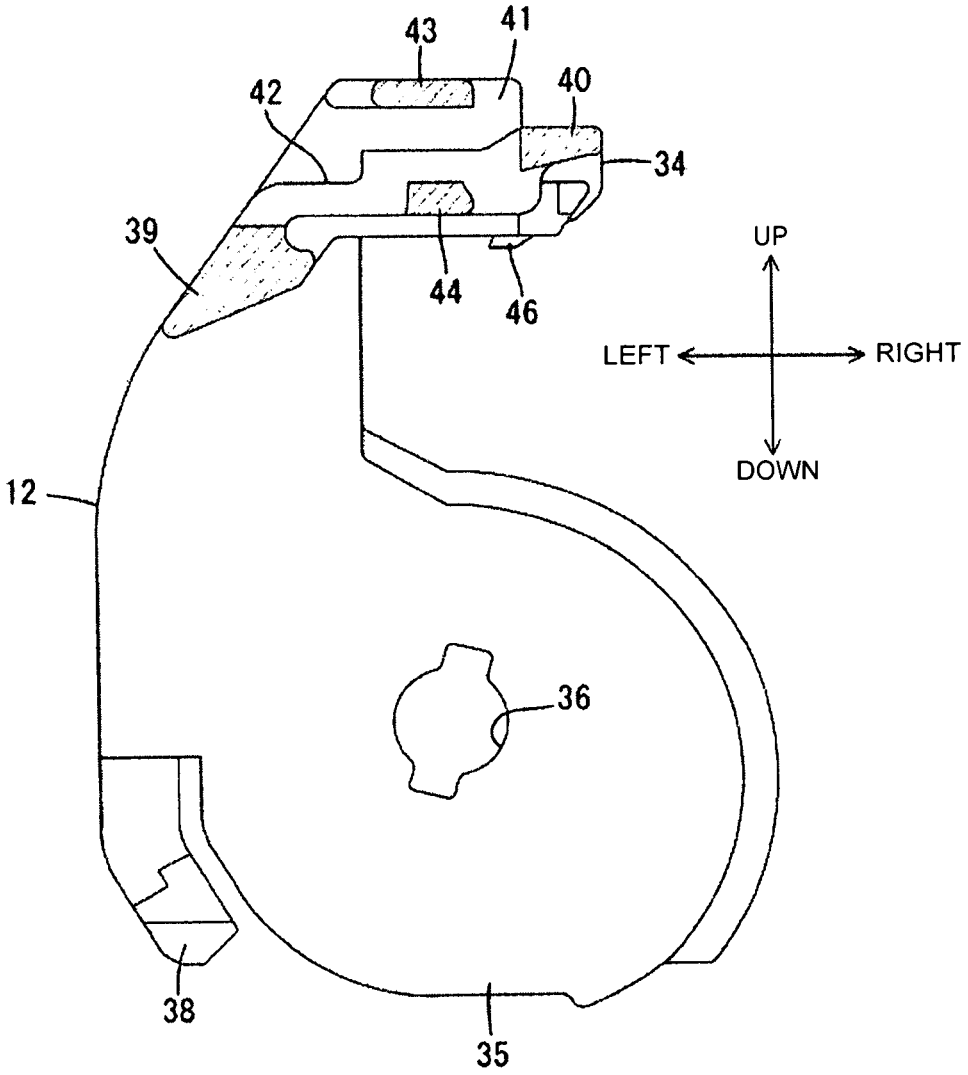
FIG. 6 is a section along A-A of FIG. 5.

As shown in FIG. 4, the operating portion 34 includes a base 39 extending in the front-rear direction between the upper ends of the cams 35, a facing portion 40 arranged away from the base 39 toward one lateral side, and two coupling arms 41 extending in the lateral direction between front and rear ends of the base 39 and the facing portion 40. The operating portion 34 also includes a lock 42 extending in the lateral direction and having an end part on one side (right side of FIG. 6) connected to the facing portion 40 and an end part on the other side (left side of FIG. 6) connected to the base 39 inside the coupling arms 41, as shown in FIG. 6. The lock 42 is vertically deflectable and deformable with the base 39 and the facing portion 40 as supports. The facing portion 40 is disposed higher than the base 39. The coupling arms 41 and the lock 42 are connected to the facing portion 40 via bent rising parts on one end side.

The coupling arms 41 include vertical wall parts rising upward and a cover 43 is provided to extend in the front-rear direction between the upper ends of the vertical wall parts. The cover 43 is arranged to cover a later-described lock body 44 of the lock 42 from above.

The lock 42 includes a hole penetrating in the vertical direction inside and the plate-like lock body 44 for partially closing the hole part at a laterally intermediate position of the hole part. Further, the lock 42 includes two guides 45 protruding toward both front and rear sides at positions overlapping the lock body 44 in the lateral direction as shown in FIG. 4. The both guides 45 are in the form of strip plates extending in the lateral direction in the lock 42.

As shown in FIGS. 4 and 5, the operating portion 34 includes lever-side locks 46 at positions of the coupling arms 41 near one side. Each of the lever-side locks 46 is in the form of a claw projecting downward. A surface of the lever-side lock 46 facing the one side is arranged to be inclined toward the other side. A surface of the lever-side lock 46 facing the other side is likewise arranged to be inclined toward the other side.

<Detector 13>

Figure 7:
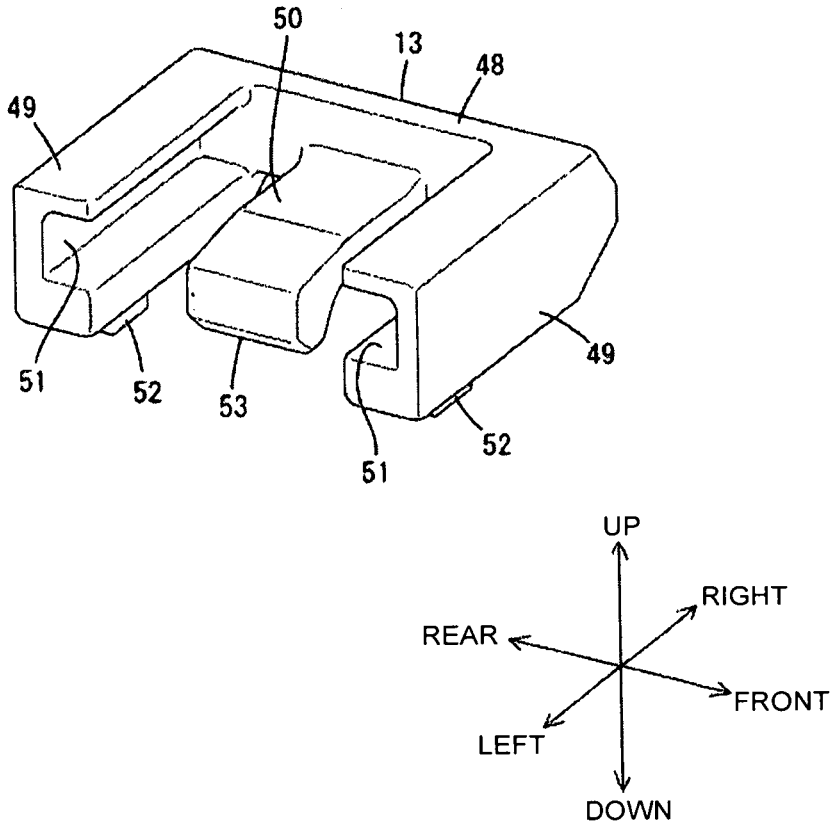
FIG. 7 is a perspective view of a detecting member.
Figure 8:
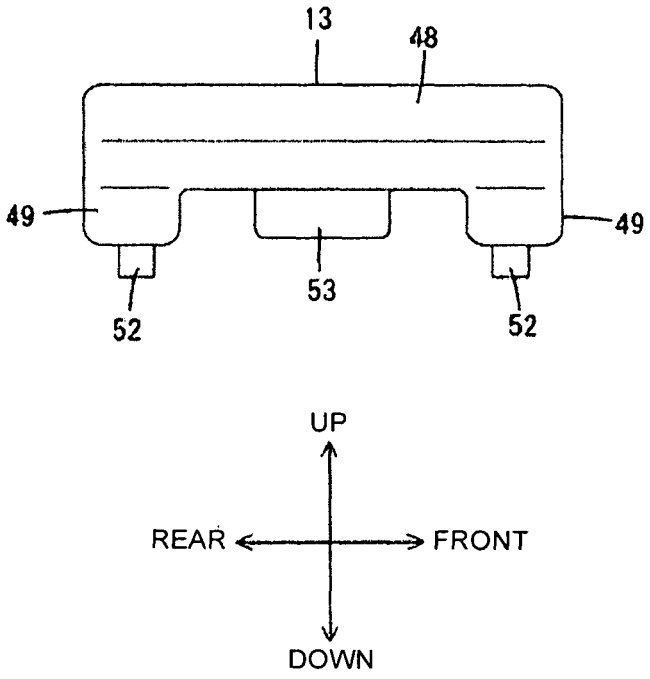
FIG. 8 is a side view of the detecting member.

The detector 13 is made of synthetic resin and incorporated into the operating portion 34 of the lever 12. As shown in FIGS. 7 and 8, the detector 13 includes a coupling 48 along the front-rear direction (lateral direction of FIG. 8), guide arms 49 projecting toward one side from both front and rear ends of the coupling 48 and a detection arm 50 projecting toward the one side from a central part of the coupling 48 in the front-rear direction.

As shown in FIG. 7, the both guide arms 49 include lock grooves 51 in the inner surfaces thereof facing each other. The lock grooves 51 of the guide arms 49 extend in the lateral direction and are open on one side. The guides 45 of the lever 12 are respectively inserted into the lock grooves 51 of the guide arms 49. The detector 13 is movable toward one side from the standby position to the detection position along the guides 45 with respect to the operating portion 34 of the lever 12.

The guide arms 49 include stoppers 52 in the form of projecting claws on the lower surfaces thereof. The escape of the detector 13 from the standby position is restricted by the contact of the stoppers 52 with the base 39 of the operating portion 34. On the other hand, the escape of the detector 13 from the detection position is restricted by the contact of the stopper portions 52 with the facing portion 40 of the operating portion 34.

Figure 10:
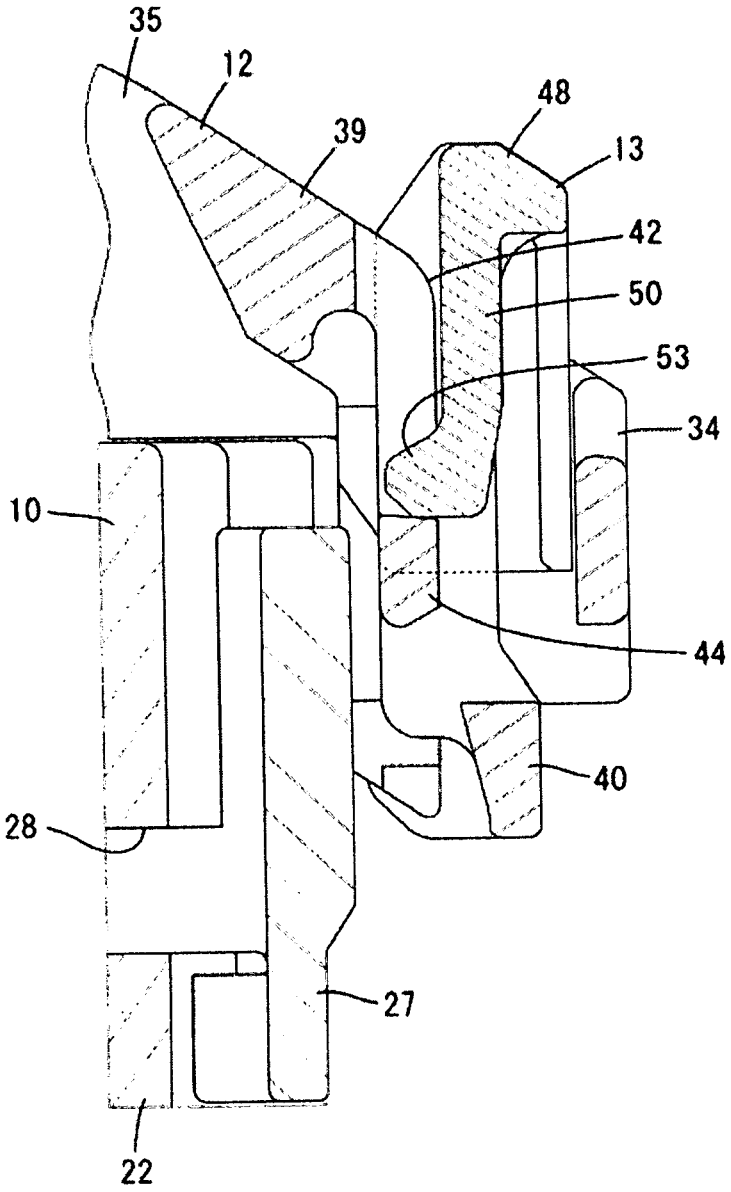
FIG. 10 is an enlarged section showing a state where the detecting member is locked by a lock portion at a standby position in FIG. 9.
Figure 13:
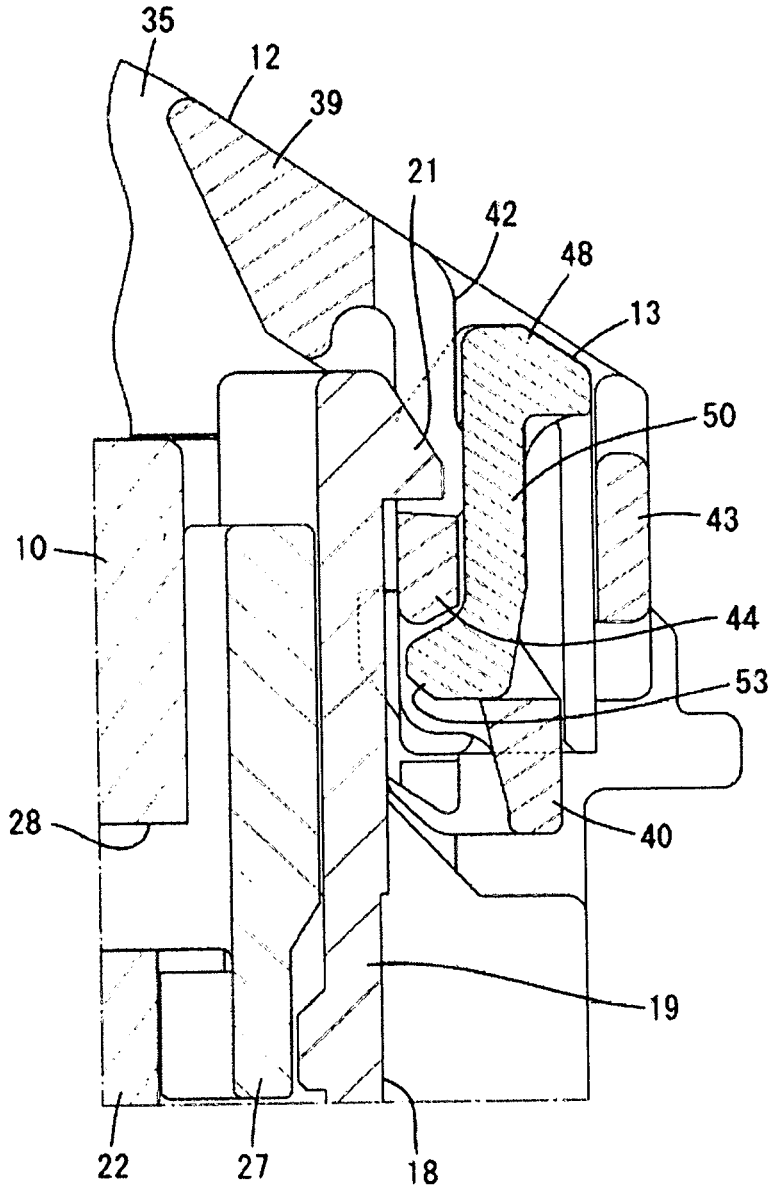
FIG. 13 is an enlarged section showing a state where the detecting member is at the detection position by being pushed from the state of FIG. 12.

The detection arm 50 is deflectable and deformable with a base end part on the side of the base 39 as a fulcrum. The detection arm 50 includes a detecting body 53 in the form of a claw projecting down on a tip part (end part on one side). As shown in FIG. 10, the detecting body 53 contacts the lock body 44 of the lock 42 from an upper side of FIG. 10 at the standby position to restrict movement of the detector 13 to the detection position. On the other hand, as shown in FIG. 13, the detecting body 53 contacts the lock body 44 of the lock 42 from a lower side of FIG. 13 at the detection position to restrict a movement of the detector 13 to the standby position.

<Transportation and Connection Method of Lever-Type Connector>

Figure 9:
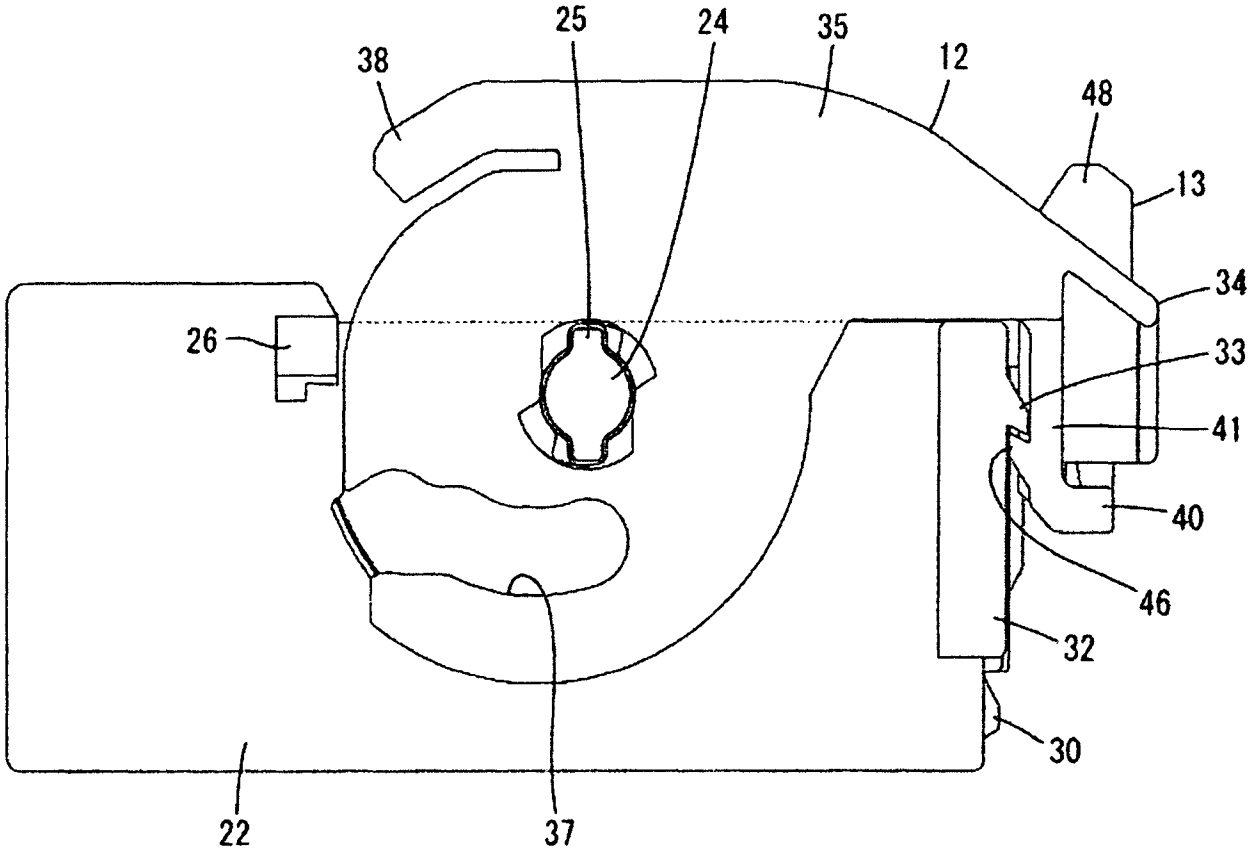
FIG. 9 is a front view showing a state where the lever is held at a retracted position with respect to the first housing.

In transporting the lever-type connector, the detector 13 is held at the standby position with respect to the operating portion 34 of the lever 12 and the lever 12 is held at the retracted position with respect to the first housing 10 (see FIG. 9). When the detector 13 is at the standby position, the detecting body 53 comes into contact with the lock body 44 to restrict a movement to the detection position and the coupling 48 is arranged to project outward toward a side opposite to the detection position from the operating portion 34 (see FIG. 10). A part of the detector 13 except the coupling 48 is arranged between the coupling arms 41 of the operating portion 34 and between the covering portion 43 and the lock 42.

When the lever 12 is at the retracted position, the operating portion 34 is located above an end surface of the first housing 10 on one side and the coupling 48 of the detector 13 is arranged to project up. The lever-side locks 46 of the operating portion 34 are resiliently locked to the housing-side locks 33 of the first housing 10. In this way, upward (toward the connection start position) rotation of the lever 12 is restricted. Further, the cams 35 contact the walls 32 of the first housing 10, thereby restricting downward rotation of the lever 12. Thus, the lever 12 is held at the retracted position with respect to the first housing 10 with rotation restricted.

Since the operating portion 34 of the lever 12 is arranged in proximity to the end surface of the first housing 10 on the one side when the lever 12 is at the retracted position, a projection amount of the lever 12 from the first housing 10 is suppressed. Thus, the lever-type connector needs not be bulky and is suitable in terms of conveyance and transportation.

On the other hand, since the coupling 48 of the detector 13 projects up from the operating portion 34 when the lever 12 is at the retracted position, the worker's hand may touch the coupling 48. However, even if the worker's hand touches the coupling 48, the detector 13 does not inadvertently move to the detection position since the detecting body 53 is kept in contact with the lock body 44.

In a conventional lever-type connector, a full locking part provided on a first housing is locked to the lock 42 and interposed between the detecting body 53 and the lock body 44 when the lever 12 is at a position corresponding to the retracted position. Thus, the detector 13 is movable to the detection position. If the worker's hand touches the coupling 48 here, the detector 13 may be pushed to the detection position.

In that respect, the full locking portion 18 is provided on the mating second housing 11 in the lever-type connector of this embodiment. The lever-side locking portions 46 are locked to the housing-side locking portions 33 of the first housing 10 and arranged at positions separated from the lock 42. Thus, unlike in the conventional lever-type connector, a state where the detector 13 is locked by the lock body 44 is satisfactorily maintained to prevent the detector 13 from inadvertently moving to the detection position when the lever 12 is at the retracted position in the lever-type connector of this embodiment.

In the lever-type connector, the unillustrated female terminal fittings are inserted into the first cavities 23 of the first housing 10 in an assembling process after transportation. Subsequently, a locked state of the lever-side locking portions 46 and the both housing-side locking portions 33 is released and the lever 12 is rotated to the connection start position. The lever 12 is held at the connection start position since the partial locking portions 38 and the partial lock receiving portions 26 are locked (see FIG. 11).

Subsequently, the first housing 10 is fit shallowly into the receptacle 15 of the second housing 11. Then, the cam shafts 17 of the second housing 11 are inserted into the entrances of the cam grooves 37 of the cams 35. In that state, the lever 12 is rotated toward the proper connection position (toward one side (right side) of FIG. 11). When a pressing force acting toward the one side is applied to the lever 12, the locked state of the partial locking portions 38 and the partial lock receiving portions 26 is released and the lever 12 becomes rotatable toward the proper connection position. In the process of moving the lever 12 toward the proper connection position, the cam shafts 17 slide on groove surfaces of the both cam grooves 37 and the first housing 10 is fit deeply into the receptacle 15 of the second housing 11.

Immediately before the lever 12 reaches the proper connection position, the full locking portion 18 of the second housing 11 is inserted between the operating part of the retainer 27 mounted in the first housing 10 and the lock 42. The full locking portion 18 is arranged to contact the end surface of the projection 30 of the first housing 10. Then, the lock body 44 interferes with the full locking projection 21 and the lock 42 is deflected and deformed. When the lever 12 reaches the proper connection position, the lock 42 resiliently returns and the full locking projection 21 is fit between the lock body 44 and the base 39 (see FIG. 12). The full locking projection 21 comes into contact with the lock body 44 from above in this way, whereby the first and second housings 10, 11 are retained and held in a properly connected state.

When the lever 12 reaches the proper connection position, the cam shafts 17 respectively reach back end sides of the cam grooves 37 and the first and second housings 10, 11 are properly connected. In this way, the unillustrated female terminal fittings are properly and conductively connected to the male terminal fittings.

Further, at the proper connection position, the lever 12 is in the same posture as at the retracted position. Thus, when the lever 12 reaches the proper connection position, the lever-side locks 46 are resiliently locked to the both housing-side locks 33.

Figure 12:
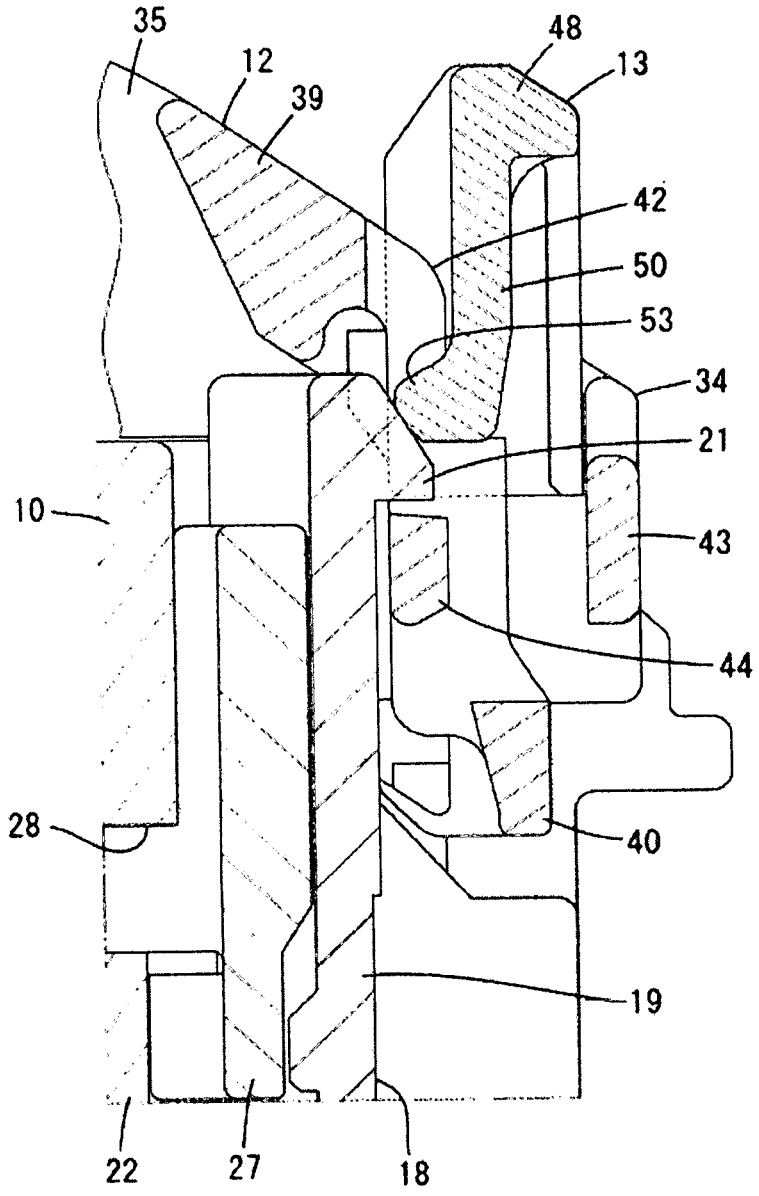
FIG. 12 is an enlarged section showing a state where the first and second housings are properly connected, the full locking portion is locked to the lock portion and the detecting member becomes movable to a detection position.

The detecting body 53 is pressed by the full locking projection 21 and separated upwardly from the lock body 44 to release the locked state with the lock body 44 (see FIG. 12). In this way, the detector 13 becomes movable to the detection position. In this state, the detector 13 is pressed down and brought to the detection position. When the detector 13 reaches the detection position, the detecting body 53 is sandwiched between the lock body 44 and the facing portion 40 and arranged to come into contact with the lock body 44 from below (see FIG. 13).

On the other hand, if the lever 12 does not reach the proper connection position and the connecting operation is stopped before the first and second housings 10, 11 reach the properly connected state, the full locking projection 21 of the full locking portion 18 does not reach a position between the lock body 44 and the base 39. Thus, the locked state of the detecting body 53 and the lock body 44 is maintained and the detector 13 cannot be pushed to the detection position. Therefore, it can be detected that the first and second housings 10, 11 are in the properly connected state if the detector 13 can move to the detection position and that the first and second housings 10, 11 are not in the properly connected state if the detecting member 13 cannot move to the detection position.

As described above, the lever 12 is held at the retracted position with respect to the first housing 10 by the lever-side locks 46 being locked to the both housing-side locks 33 during the conveyance and transportation of the lever-type connector. The both lever-side locks 46 are separately disposed at the positions different from the lock 42. Thus, the detector 13 can be satisfactorily kept locked by the lock 42 without interfering with the both housing-side locks 33 at the standby position.

Further, any of the lever-side locks 46 and the lock 42 is provided in the operating portion 34 of the lever 12. Thus, the worker can quickly perform an operation of releasing the locked state of each of the lever-side locks 46 and the lock 42 and other operations while holding the operating portion 34, and workability is excellent.

Furthermore, with the lever 12 located at the retracted position, the full locking portion 18 is locked to the lock 42 and the first and second housings 10, 11 are at the same positions as in the properly connected state. Thus, when the first and second housings 10, 11 are in the properly connected state, the lever-side locks 46 and the housing-side locks 33 are locked in addition to the locking of the full locking portion 18 and the lock 42. Therefore, reliability in maintaining the connected state of the first and second housings 10, 11 is enhanced.

Other Embodiments

The embodiment disclosed above should be construed as illustrative rather than restrictive in all aspects.

For example, although the lever 12 has a U-shape in the above embodiment, the lever 12 may be in the form of a single plate constituted by one cam portion 35 as another embodiment.

Although the lever 12 is provided with the lever-side locking portions 46 in the above embodiment, only one lever-side locking portion 46 may be provided as another embodiment. In this case, only one housing-side locking portion 33 may be provided to correspond to the lever-side locking portion 46.

Although the lever-side locking portions 46 are provided on the operating portion 34 of the lever 12 in the above embodiment, the lever-side locking portions 46 may be provided on a part of the lever 12 other than the operating portion 34 as another embodiment.

Although the lock 42 is in the form of a beam having both ends supported on the operating portion 34 in the above embodiment, the lock 42 may be in the form of a cantilever provided on the operating portion 34 as another embodiment.

The lock 42 is deflected and deformed and the full locking portion 18 is incapable of being deflected or deformed in the above embodiment. However, the locking portion 18 may be deflected and deformable and the lock 42 may be incapable of being deflected or deformed as another embodiment.

LIST OF REFERENCE SIGNS

10 . . . first housing
11 . . . second housing
12 . . . lever
13 . . . detector
14 . . . second housing body
15 . . . receptacle
16 . . . second cavity
17 . . . cam shaft
18 . . . full locking portion
19 . . . locking body
20 . . . reinforcing portion
21 . . . full locking projection
22 . . . first housing body
23 . . . first cavity
24 . . . shaft

25 . . . retaining piece
26 . . . partial lock receiving portion
27 . . . retainer
28 . . . mounting hole
29 . . . protrusion
30 . . . projection
31 . . . recess
32 . . . wall
33 . . . housing-side lock
34 . . . operating portion
35 . . . cam
36 . . . bearing hole
37 . . . cam groove
38 . . . partial locking portion
39 . . . base portion
40 . . . facing portion
41 . . . coupling arm
42 . . . lock
43 . . . cover
44 . . . lock body
45 . . . guide
46 . . . lever-side lock
48 . . . coupling
49 . . . guide arm
50 . . . detection arm
51 . . . lock groove
52 . . . stopper
53 . . . detecting body

What is claimed is:

1. A lever-type connector, comprising:

a first housing;

a lever provided rotatably to a retracted position and a connection start position about a shaft with respect to the first housing;

a second housing to be connected to the first housing by rotation of the lever from the connection start position; and a detector provided movably to a standby position and a detection position with respect to the lever, wherein:

the lever includes a lock on an end part separated from the shaft, the second housing includes a full locking portion to be locked to the lock when the first and second housings are connected properly, the detector is locked by the lock at the standby position and becomes movable to the detection position when the full locking portion is locked to the lock, the first housing includes a housing-side lock, the lever includes a lever-side lock to be locked to the housing-side lock at the retracted position, and the lever-side lock is at a position different from the lock of the lever.

2. The lever-type connector of claim 1, wherein the lever-side lock is disposed on an end part of the lever separated from the shaft.

3. The lever-type connector of claim 2, wherein the retracted position is the same position as when the full locking portion is locked to the lock to reach the proper connection.

4. The lever-type connector of claim 1, wherein the retracted position is the same position as when the full locking portion is locked to the lock to reach the proper connection.

* * * * *